US006287131B1

(12) United States Patent
Deng

(10) Patent No.: US 6,287,131 B1
(45) Date of Patent: Sep. 11, 2001

(54) PLUG WITH A RECEIVING MEMBER FOR GROUNDING PRONG

(76) Inventor: C. C. Deng, No. 1, Alley 50, Lane 305, Sec. 3, Chung-Shan Rd., Zantze Hsiang, Taichung County (TW)

( * ) Notice: Subject to any disclaimer, the term of this patent is extended or adjusted under 35 U.S.C. 154(b) by 0 days.

(21) Appl. No.: 09/617,265

(22) Filed: Jul. 17, 2000

(51) Int. Cl.[7] ..... H01R 13/648
(52) U.S. Cl. ..... 439/103; 439/171; 439/692
(58) Field of Search ..... 439/103, 106, 439/171, 172, 692, 695, 697

(56) References Cited

U.S. PATENT DOCUMENTS 4,015,888 * 4/1977 Draper et al. ..... 339/14

* cited by examiner

*Primary Examiner*—Paula Bradley
*Assistant Examiner*—Truc Nguyen
(74) *Attorney, Agent, or Firm*—Rosenberg, Klein & Lee

(57) ABSTRACT

A plug includes a housing having a compartment, a base mounted in the housing, two blades securely attached to the base, and a grounding prong that is electrically connected to an external grounding wire. The base includes an inner side facing the compartment of the housing and an outer side facing away from the compartment of the housing. A receiving member extends from the inner side of the base and locates in the compartment. The grounding prong includes a first end and a second end. The first end of the grounding prong is securely, releasably engaged with the base with the second end of the grounding prong extended out of the housing for use with a socket with a ground slot. The grounding prong is removably received in a receptacle of the receiving member when used with a socket without a ground slot.

2 Claims, 7 Drawing Sheets

PLUG WITH A RECEIVING MEMBER FOR GROUNDING PRONG

BACKGROUND OF THE INVENTION

1. Field of the Invention

The present invention relates to a plug with a receiving member for the grounding prong of the plug. More particularly, the present invention relates to a plug with a receiving member, wherein the grounding prong of the plug is received in the receiving member when the plug is used with a socket without a ground slot, and wherein the grounding prong of the plug is removed from the receiving member and secured in place so as to be used with a socket with a ground slot.

2. Description of the Related Art

FIG. 6 of the drawings illustrates a conventional plug 70 with two blades 72 and a grounding prong 71 that can be used with a socket with a ground slot. When used with a socket without a ground slot, the grounding prong 71 is cut (see FIG. 8), yet the plug 70 cannot be used with a socket with a grounding slot anymore. A solution to solve this problem is to use an additional adaptor 80 with two blades 81, as shown in FIG. 7. However, the adaptor 80 may not be readily available such that the user has to go out to buy a new one. Inconvenience is thus occurred.

SUMMARY OF THE INVENTION

It is the primary object of the present invention to provide a plug with a receiving member, wherein the grounding prong of the plug is received in the receiving member when the plug is used with a socket without a ground slot, and wherein the grounding prong of the plug is removed from the receiving member and secured in place so as to be used with a socket with a ground slot.

In accordance with one aspect of the invention, a plug comprises:

a housing defining a compartment therein and including an end;

a base mounted in the end of the housing and including an inner side facing the compartment of the housing and an outer side facing away from the compartment of the housing, a receiving member extending from the inner side of the base and locating in the compartment, the receiving member including a receptacle;

two blades securely attached to the base;

a grounding prong including a first end and a second end, the first end of the grounding prong being securely, releasably engaged with the base with the second end of the grounding prong extended out of the housing for use with a socket with a ground slot, the grounding being removably received in the receptacle of the receiving member when used with a socket without a ground slot; and means for electrically connecting the grounding prong to an external grounding wire.

In an embodiment of the invention, a plug comprises:

a housing defining a compartment therein and including an end;

a base mounted in the end of the housing and including an inner side facing the compartment of the housing and an outer side facing away from the compartment of the housing, a receiving member extending from the inner side of the base and locating in the compartment, the receiving member including a receptacle with an opening section;

a ground connector including a tubular member formed thereon, the tubular member being received in the opening section, the grounding connector being adapted to be electrically connected to an external grounding wire;

two blades securely attached to the base; and a grounding prong including a first end and a second end, the first end of the grounding prong being securely, releasably engaged with the tubular member with the second end of the prong extended out of the housing for use with a socket with a ground slot, the grounding being removably received in the receiving member when used with a socket without a ground slot.

The first end of the grounding prong is threaded and the tubular member of the ground connector includes an inner threading for engaging with the threaded first end of the grounding prong. The threaded first end of the grounding prong includes a slot in an end face thereof.

The base includes a positioning slot, and the ground connector is 7-shape and includes a mediate section having a first end and a second end. The tubular member is formed on the first end of the mediate section and a connecting blade extends from the second end of the mediate section and extends through the positioning slot of the base. The connecting blade is adapted to be electrically connected with the external wire. The outer side of the base includes a recessed portion for receiving the mediate section of the ground connector. The recessed portion of the outer side of the base includes a protrusion, and the mediate section of the ground connector includes a slot that receives the protrusion to thereby provide a positioning effect. A positioning member extends from the inner side of the base, and the positioning groove extends through the positioning member for snugly receiving the connecting blade of the connector.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
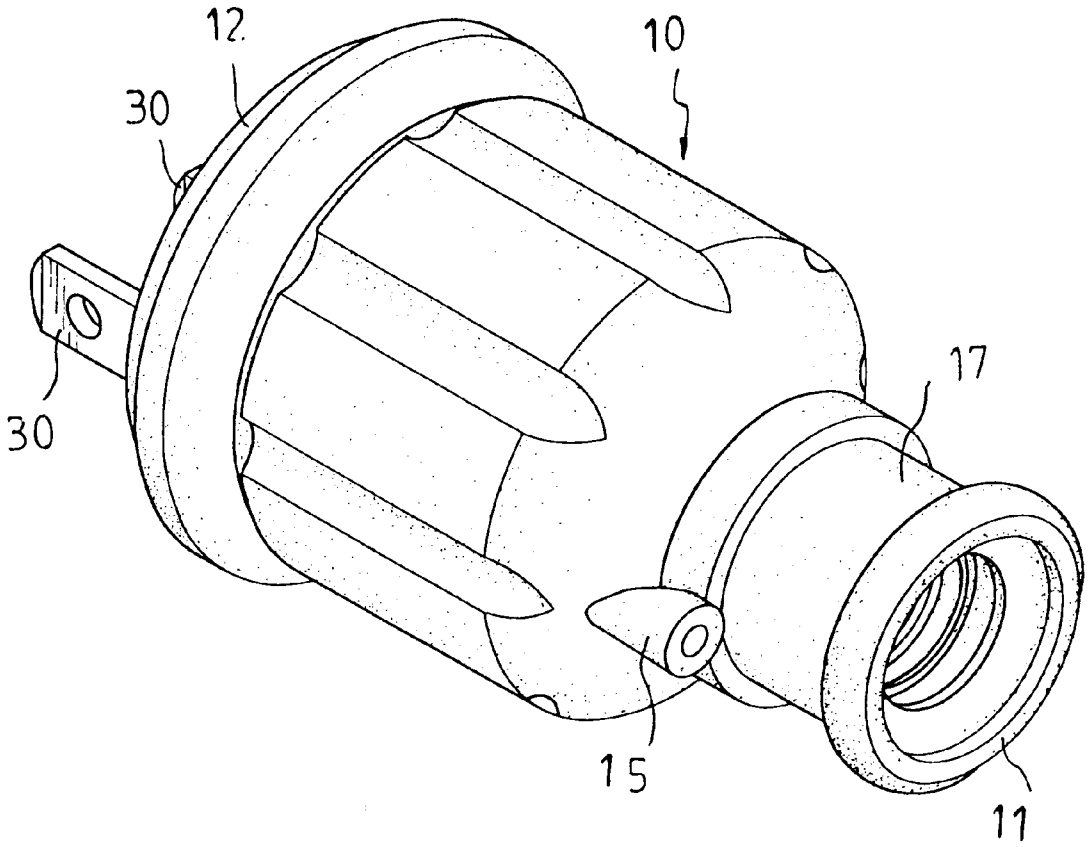
FIG. 1 is a perspective view of a plug in accordance with the present invention.
Figure 2:
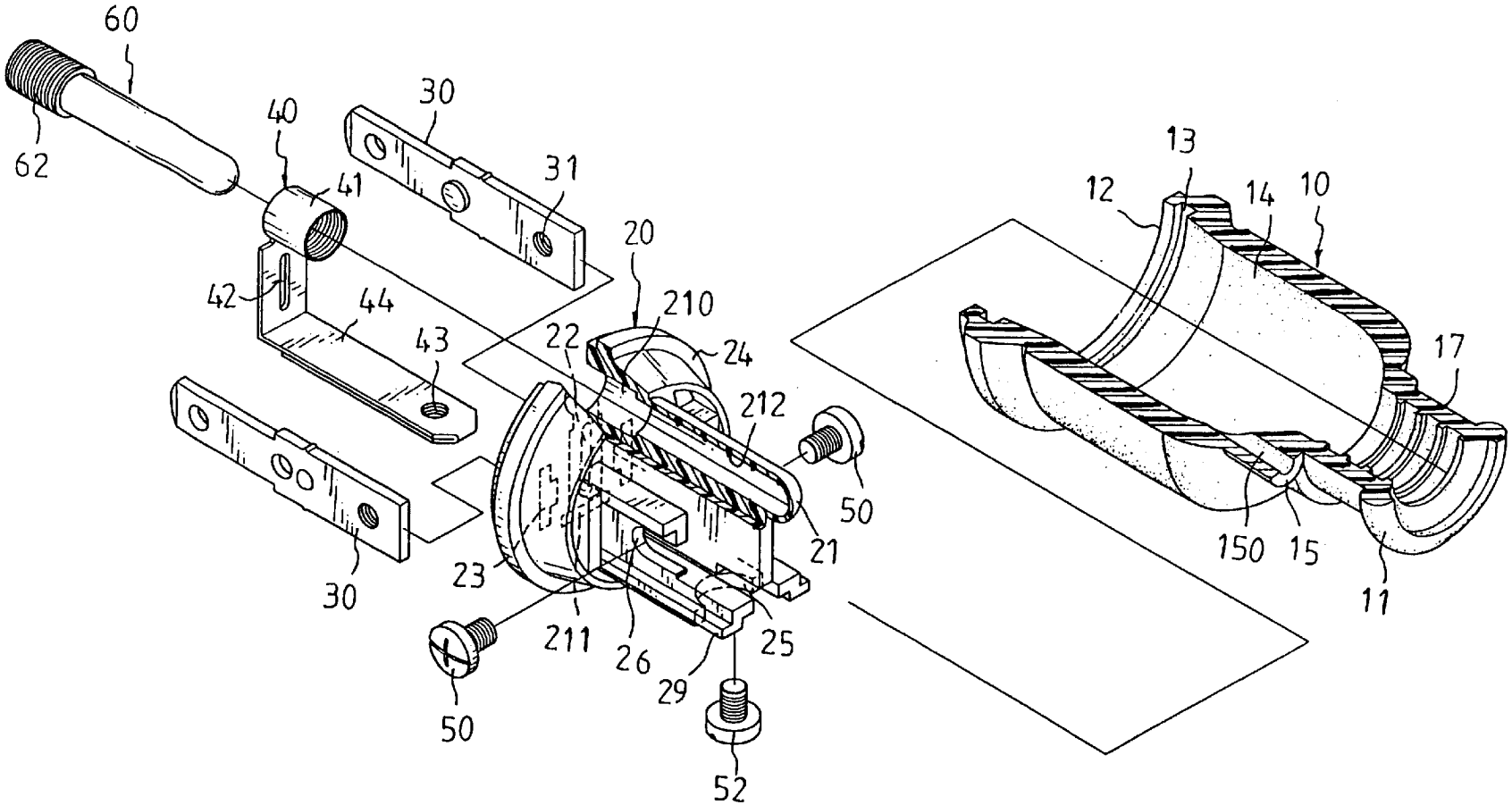
FIG. 2 is an exploded perspective view, partly cutaway and partly sectioned, of the plug in accordance with the present invention.
Figure 3:
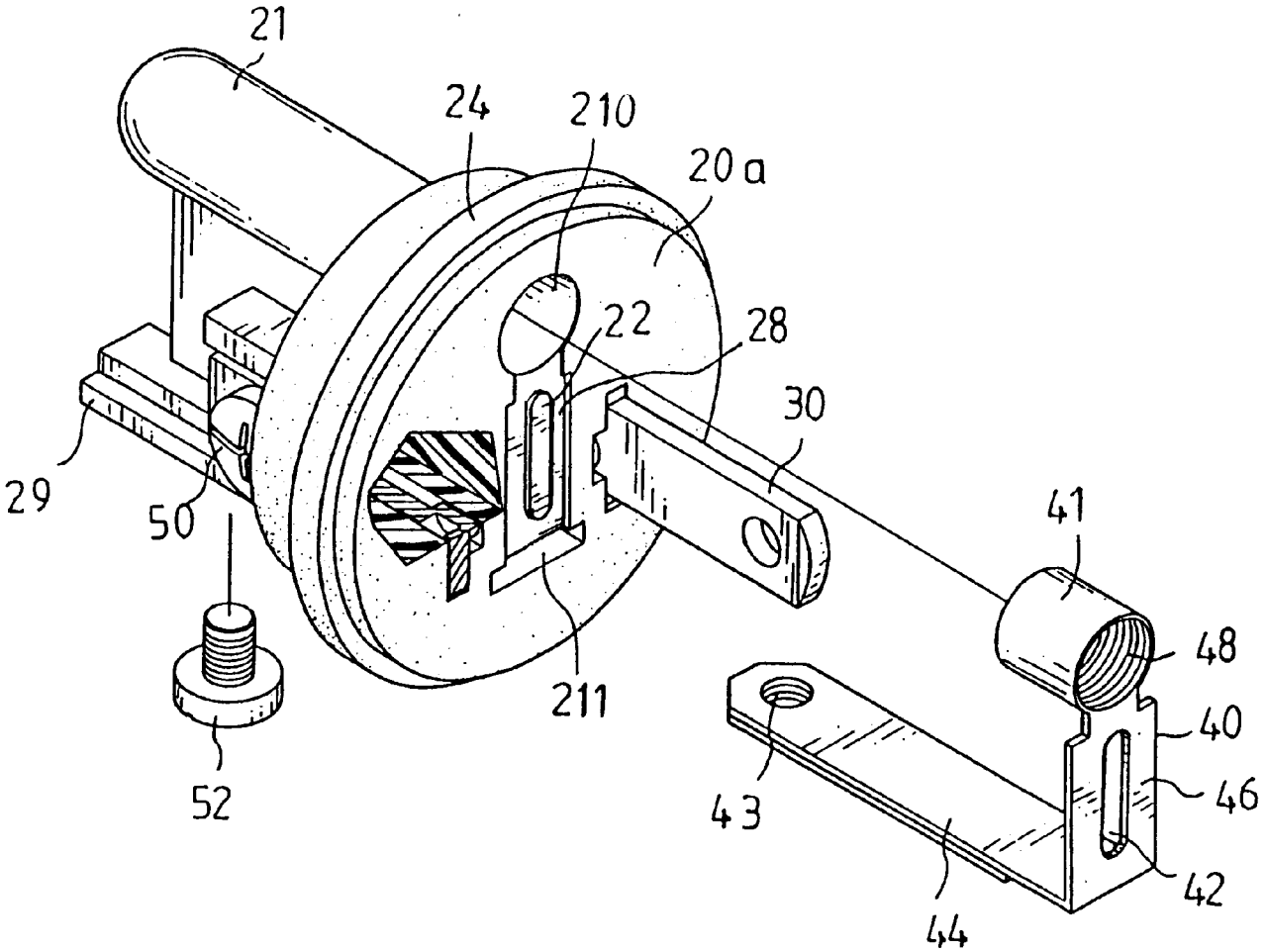
FIG. 3 is an exploded perspective view illustrating the other side of a base of the plug in accordance with the present invention, wherein the housing of the plug is removed for clarity.

Referring to FIGS. 1 through 5 and initially to FIGS. 1 and 2, a plug in accordance with the present invention generally includes a housing 10, a base 20, two blades 30, a ground connector 40, and a grounding prong 60. The housing 10 is substantially bell-shape having a relatively smaller end 11 through which electric wires extend and a relatively larger end 12 having an annular groove 13 defined in an outer periphery thereof The housing 10 further includes a compartment 14 for receiving the base 20. Further, the housing 10 includes a grounding wire hole 150 at 15 through which a grounding wire (not shown) extends for connection with the grounding prong 60.

The base 20 includes a flange 24 that is snugly received in the annular grove 13 of the housing 10, thereby securely mounting the base 20 in the compartment 14 of the housing 10. The base 20 includes a receiving member 21 extended from an inner side thereof and located in the compartment 14 of the housing 10. The receiving member 21 includes a receptacle 212 with an opening section 210. The base 20 further includes two slots 23 through which the blades 30 extend, respectively, and screws 50 are used to secure the blades 30 to positioning slots 26 defined in the base 20, which is conventional and therefore not described further. Further, the base 20 includes a positioning member 29 extended from the inner side of the base 20. The positioning member 29 includes a positioning groove 211 that extends to an outer face 20*a* of the base 20, best shown in FIG. 3. The outer face 20*a* of the base 20 further includes a recessed portion 28 with a protrusion 22.

The ground connector 40 is substantially 7-shape and includes a mediate section 46 with a slot 42. The ground connector 40 further includes a connecting blade 44 extending from an end of the mediate section 46 and a tubular member 41 formed on the other end of the mediate section 46. The grounding prong 60 includes a threaded end 62.

In assembly, the connecting blade 44 of the ground connector 40 is inserted through the positioning groove 211. It is noted that the connecting blade 44 may include an increased thickness so as to be snugly received in the positioning groove 211. The mediate section 46 is snugly received in the recessed portion 28 of the base 20 with the protrusion 22 of the base 20 inserted into the slot 42 of the mediate section 46, thereby securely positioning the ground connector 40. It is noted that the mediate section 46 is flush with the outer face 20*a* of the base 20 to provide a neat appearance. The tubular member 41 of the ground connector 40 is received in the opening section 210 of the receptacle 212 of the receiving member 21. A screw 52 is extended through a screw hole 42 in the connecting blade 44 of the ground connector 40 and then secured to a positioning hole 25 in the positioning member 29. The screw 52 is thus in contact with the connecting blade 44 of the ground connector 40 for securely positioning an end of an external grounding wire (not shown) that extends out of the housing 10 via the grounding wire hole 150.

Figure 5:
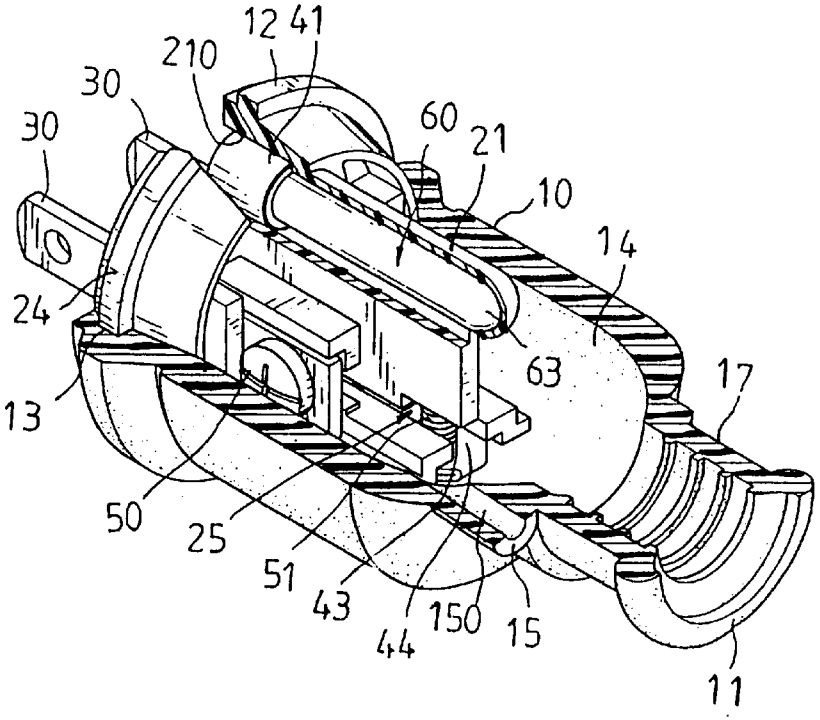
FIG. 5 is a view similar to FIG. 4, wherein the plug is used with a socket without a ground slot.
Figure 4:
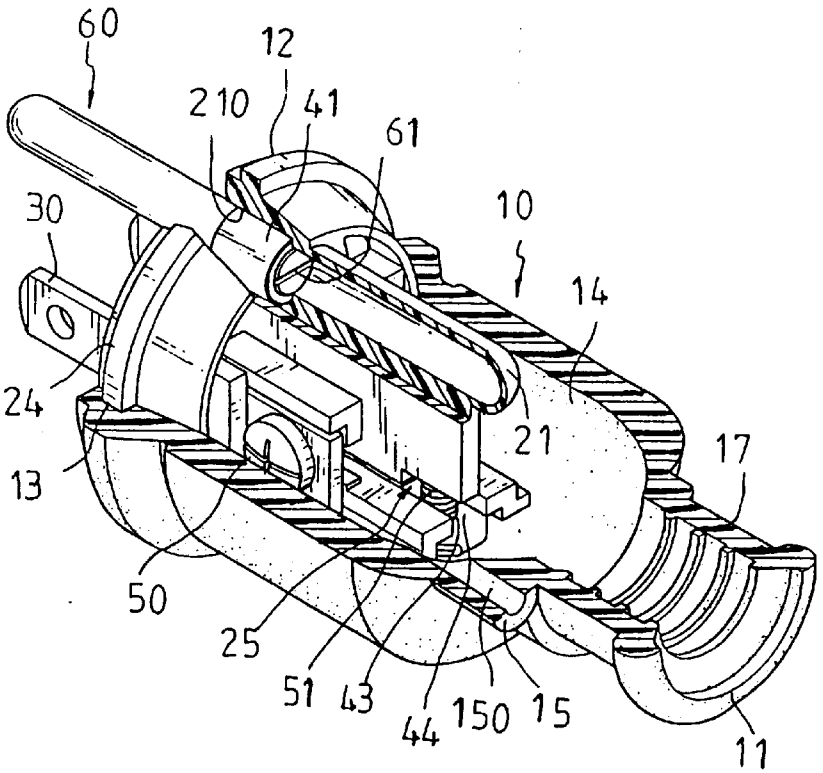
FIG. 4 is a perspective view, partly cutaway, of the plug in accordance with the present invention, wherein the plug is used with a socket with a ground slot.
Figure 6:
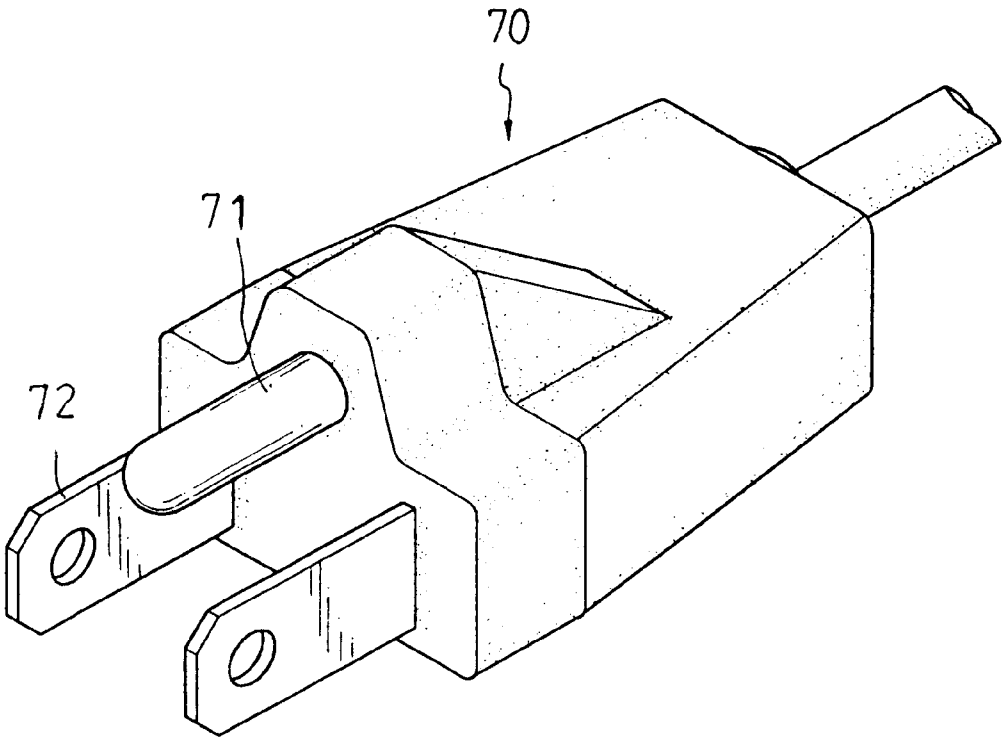
FIG.6 PRIOR ART
FIG. 6 is a perspective view of a conventional plug.
Figure 7:
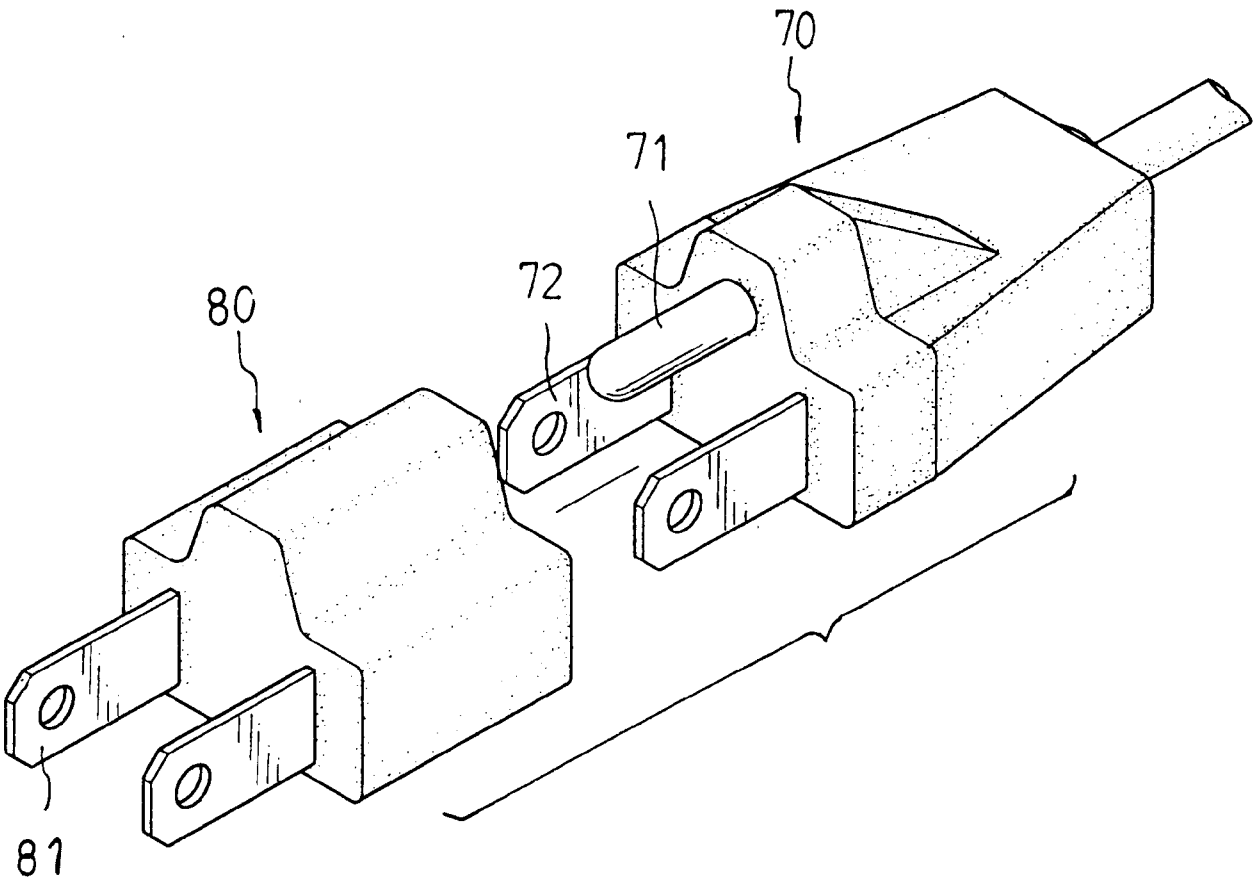
FIG. 7 PRIOR ART
FIG. 7 is an exploded perspective view of the conventional plug and an adaptor.
Figure 8:
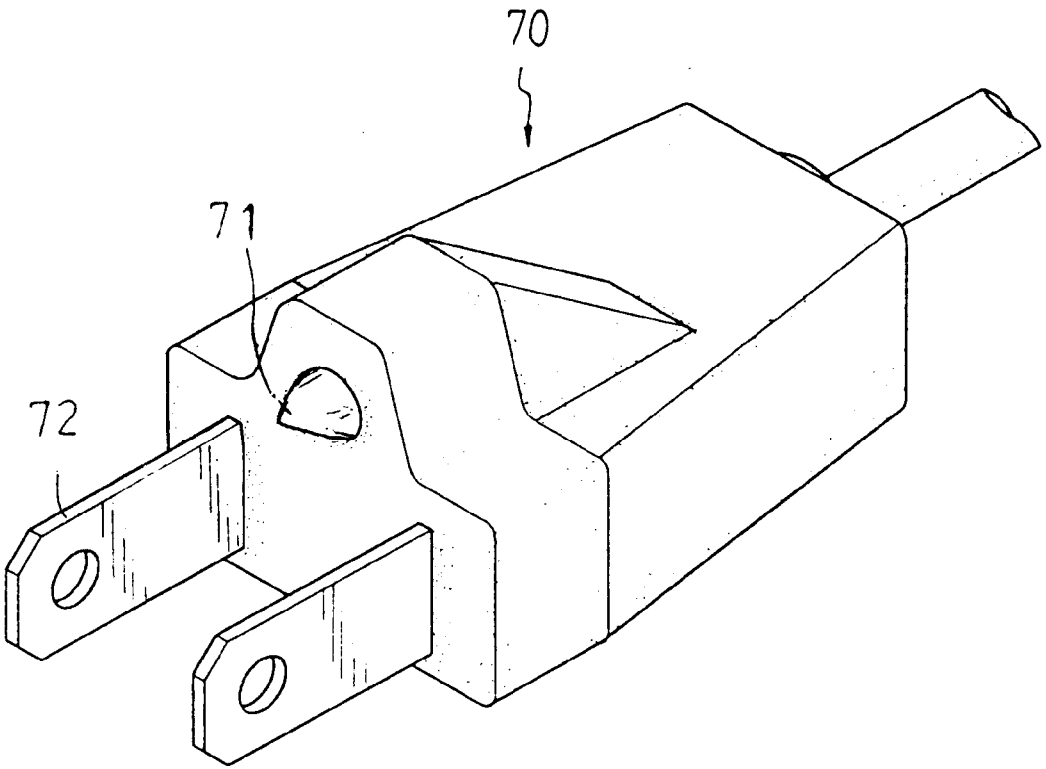
FIG.8 PRIOR ART
FIG. 8 is a perspective view of the conventional plug, wherein the grounding prong of the plug is cut for using with a socket without a ground slot.

Referring to FIG. 4, when the plug is used with a socket (not shown) with a ground slot, the threaded section 62 of the grounding prong 60 is threadedly engaged with inner threading 48 (FIGS. 2 and 3) of the tubular member 41 of the ground connector 40 with the other end of the grounding prong 60 extended out of the housing 10. Referring to FIG. 5, when the plug is used with a socket (not shown) without a ground slot, the grounding prong 60 is inserted into the receptacle 212 of the receiving member 21 with the threaded section 62 of the grounding prong 60 threadedly engaged with the inner threading 48 of the tubular member 41 of the ground connector 40. The threaded end 62 of the grounding prong 60 includes a slot 61 (FIG. 4) in an end face thereof to allow easy engagement/disengagement of the threaded end 62 without the tubular member 60 by a tool, e.g., a screwdriver with a cabinet tip.

According to the above description, it is appreciated that the present invention provides a useful plug that can be used with both types of sockets.

Although the invention has been explained in relation to its preferred embodiment, it is to be understood that many other possible modifications and variations can be made without departing from the scope of the invention as hereinafter claimed.

What is claimed is:

1. A plug comprising:

a housing having a compartment therein and an open end in communication with the compartment;

a base mounted in the open end of the housing and including an inner side facing the compartment of the housing and an outer side facing away from the compartment of the housing, the outer side having a recessed portion formed therein, the base including a receiving member extending from the inner side thereof and being located in the compartment, the receiving member including a receptacle with an opening section, the base having a positioning slot formed therein;

a ground connector including a tubular member formed thereon, the tubular member being received in the opening section, the ground connector being adapted to be electrically connected to an external grounding wire, the ground connector including a mediate section having a first end and a second end, the tubular member being formed on the first end of the mediate section, a connecting blade extending from the second end of the mediate section and extending through the positioning slot of the base, the connecting blade being electrically connected to the external grounding wire, the mediate section of the ground connector being received in the recessed portion of the outer side of the base;

two blades securely attached to the base; and a grounding prong including a first end and a second end, the first end of the grounding prong being securely, releasably engaged with the tubular member, the second end of the prong extending out of the housing for use with a socket having a ground slot, the grounding prong being removably received in the receiving member when used with a socket without a ground slot.

2. The plug as claimed in claim 1, wherein the recessed portion of the outer side of the base includes a protrusion, and wherein the mediate section of the ground connector includes a slot that receives the protrusion to thereby provide a positioning effect.

* * * * *